US006514103B2

(12) United States Patent
Pape et al.

(10) Patent No.: US 6,514,103 B2
(45) Date of Patent: Feb. 4, 2003

(54) PRINTED CIRCUIT BOARD CONNECTOR

(75) Inventors: Günter Pape, Enger (DE); Andreas Kohler, Minden (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/867,336

(22) Filed: May 29, 2001

(65) Prior Publication Data

US 2001/0049229 A1 Dec. 6, 2001

(30) Foreign Application Priority Data

Jun. 2, 2000 (DE) ..... 100 27 556

(51) Int. Cl.[7] ..... H01R 13/648
(52) U.S. Cl. ..... 439/608; 439/79
(58) Field of Search ..... 439/79, 607, 608, 439/80

(56) References Cited

U.S. PATENT DOCUMENTS 4,909,743 A * 3/1990 Johnson et al. ..... 439/60
5,115,964 A 5/1992 Ameen et al. ..... 228/180.2
5,702,257 A * 12/1997 Millhimes ..... 439/79
5,795,191 A * 8/1998 Preputnick et al. ..... 439/608
6,146,202 A * 11/2000 Ramey et al. ..... 439/608
6,231,391 B1 * 5/2001 Ramey et al. ..... 439/608

FOREIGN PATENT DOCUMENTS

DE 195 17 977 11/1996
DE 199 49 160 4/2000

* cited by examiner

*Primary Examiner*—Tulsidas Patel
(74) *Attorney, Agent, or Firm*—Cook, Alex, McFarron, Manzo, Cummings & Mehler, Ltd.

(57) ABSTRACT

In a compact printed circuit board connector adapted to be mounted at a printed circuit board and intended to be soldered to the printed circuit board simultaneously with other electrical components in a heating oven by using a solder paste for soldering the components, a channel is provided which extends through the interior of the printed circuit board connector. The channel serves for circulating a flow of heated gas through the interior of the connector in order to quickly achieve the required soldering temperature at the soldering ends of the contact elements.

13 Claims, 5 Drawing Sheets

PRINTED CIRCUIT BOARD CONNECTOR

The invention relates to a printed circuit board connector.

BACKGROUND OF THE INVENTION

A typical printed circuit board connector comprises an isolating housing and contact elements which are arranged therein, are preferably formed angled and have a plug-in side, an intermediate portion and a connecting side with contact ends adapted to be mounted at a printed circuit board.

In order to provide a multiple pole plug-in connection, a complementary connector can be plugged into such a printed circuit board connector, the printed circuit board connector being either formed as male connector or female connector. The contact elements arranged in the isolating housing at the plug-in side in rows and columns have contacts which in case of a female connector are formed as spring contacts or in case of a male connector as contact blades and are provided for forming a contact with corresponding contact blades and contact springs, respectively, of the complementary connector.

At the other side of the housing, contact ends connected with the contact elements are provided, the contact ends being adapted to be connected with connecting portions of a printed circuit board. The contact ends are arranged at a right angle with respect to the plug-in direction of the connector.

Typically, the contact ends are soldered to the conductor tracks of the printed circuit board. A problem hereby is that all contact ends at the connecting side need to be heated as uniformly as possible in order to achieve a soldering point at each of the contact ends with an evenly high quality.

German Patent Publication 199 49 160 shows an electrical connector for connecting a conductor track on a printed circuit board, the connector having a housing with a front face and an opposite back face. In the housing are arranged contact chambers in rows and columns, in which angled electrical contacts for contacting a complementary connector accommodated. The contacts have an intermediate portion which is arranged at least partially outside of the housing, and further a solderable connecting portion for contacting and being soldered to a conductor track, the printed circuit board being contacted from two sides.

German Patent 195 17 977 shows an electronical component for being connected to a printed circuit board in a surface mounting technique, conducting elements made from an electrically conducting material being held in an isolating carrier material. The carrier element is provided with at least one window through which energy heating the contact portion can be radiated into the carrier element.

U.S. Pat. No. 5,115,964 shows a solder connection between a flexible circuit carrier and an electronical component. In order to allow to solder the soldering connections of the electronical component to the conductor tracks at the lower side of the circuit carrier, openings are provided in the dielectrical carrier layer of the circuit carrier whereby a heating gas used for soldering is able to heat the conductor tracks and to provide for an electrical connection with the soldering connections arranged below.

It is further known for printed circuit board connectors to have the contact elements completely embedded into an isolating housing with the exception of the protruding contact ends. This leads to high requirements with respect to the position accuracy of the connections to be placed, in particular with connectors which are positioned by means of handling robots on a printed circuit board. The high position accuracy is achieved by forming and mounting the housing of the connector in an exact manner and by using short protruding contact ends in order to prevent any bending of the contact ends. This means that the contact ends are embedded in the isolating housing to the highest possible extent. Accordingly, the contact ends of the contact elements which are for example bent by 90 degrees are mostly embedded in correspondingly shaped housing parts of an isolating housing. This can be achieved by contact elements which are inserted into segments or which are individually embedded and then combined in a carrier housing as a printed circuit board connector.

When components and connectors which are arranged at a printed circuit board are simultaneously soldered in a heating oven in which the energy means for heating a solder paste used as soldering means is a flow of heated air or gas, there is the risk that not all of the soldering ends of the contact elements reach the soldering temperature required for achieving an optimum soldering point simultaneously, that is at the same time with other components of the printed circuit board, this being due to the encapsulated and thereby thermally isolating construction of such printed circuit board connectors. In case of an excessive sejourn time in the heating oven, this can lead to an excessive temperature and to destruction of the electronical components, and an insufficient sejourn time can result in defective soldering points.

The invention is based on the object of improving a printed circuit board connector of the type initially mentioned so that all soldering ends of the contact elements are uniformly and without delay sufficiently exposed to a heating energy in order to allow for being soldered to a printed circuit board.

BRIEF DESCRIPTION OF THE INVENTION

The invention provides a printed circuit board connector having an isolating housing, contact elements arranged in the housing, each the said contact elements comprising a plug-in side, an intermediate portion and a connecting side with contact ends adapted to be mounted at a printed circuit board, and having a plurality of channels which are in touch with the intermediate portions of the contact elements. The advantages provided by the invention particularly reside in the fact that the channel allows the heating gas to flow through the interior of the connector even when a large number of contact elements are arranged in rows in a staggered manner, the flow of heated gas allowing to quickly heat the internally arranged intermediate portions of the contact elements. Due to the good thermal conductivity of the contact elements made from metal, this allows to quickly heat the contact ends which leads to a uniform soldering.

The intermediate portions of the contact elements may project into the channel or be formed adjacent thereto. In any case, it is important to achieve a good heat transfer from the medium flowing through the channel to the intermediate portions.

According to a preferred embodiment of the invention, the channel is formed from a first partial channel extending approximately perpendicularly with respect to the printed circuit board, and a second partial channel extending approximately parallel to the printed circuit board. The first partial channel can be formed by a recess extending approximately perpendicularly with respect to the printed circuit board, the recess being formed in segments which accommodate the contact elements. The second partial channel can be formed by a distance between the surface of the printed circuit board and intermediate walls of a segment holder which holds the segments accommodating the contact elements. The distance between the intermediate walls of the segment holder and the surface of the printed circuit board may change over the intermediate wall. Using two partial channels which are perpendicularly with respect to each other allows to use a printed circuit board without an opening which is aligned with the channel extending perpendicularly with respect to the printed circuit board. Accordingly, the printed circuit board need not be adapted to the connector, which is an advantage. The partial channel extending perpendicularly with respect to the printed circuit board assists in the circulation of the hot gases through the channel by acting in the manner of a chimney.

According to the preferred embodiment, a second channel extending approximately perpendicularly with respect to the printed circuit board is provided at the plug-in portion of the contact elements in the isolating housing. This allows to heat the contact elements arranged in the inner centre.

An additional advantage results from suitably formed contact ends of the contact elements which allows to use contact elements with press-in contact ends in an otherwise unchanged housing. This is advantageous since the angled printed circuit board connector intended for being soldered in surface mounting technique can be pressed into bores in a printed circuit board with a simple, flat tool.

Advantageous details of the invention are specified in the subclaims.

BRIEF DESCRIPTION OF THE DRAWINGS

The drawings show an embodiment of the invention which is explained in detail below. In the drawings.

DETAILED DESCRIPTION OF THE INVENTION

Figure 1:
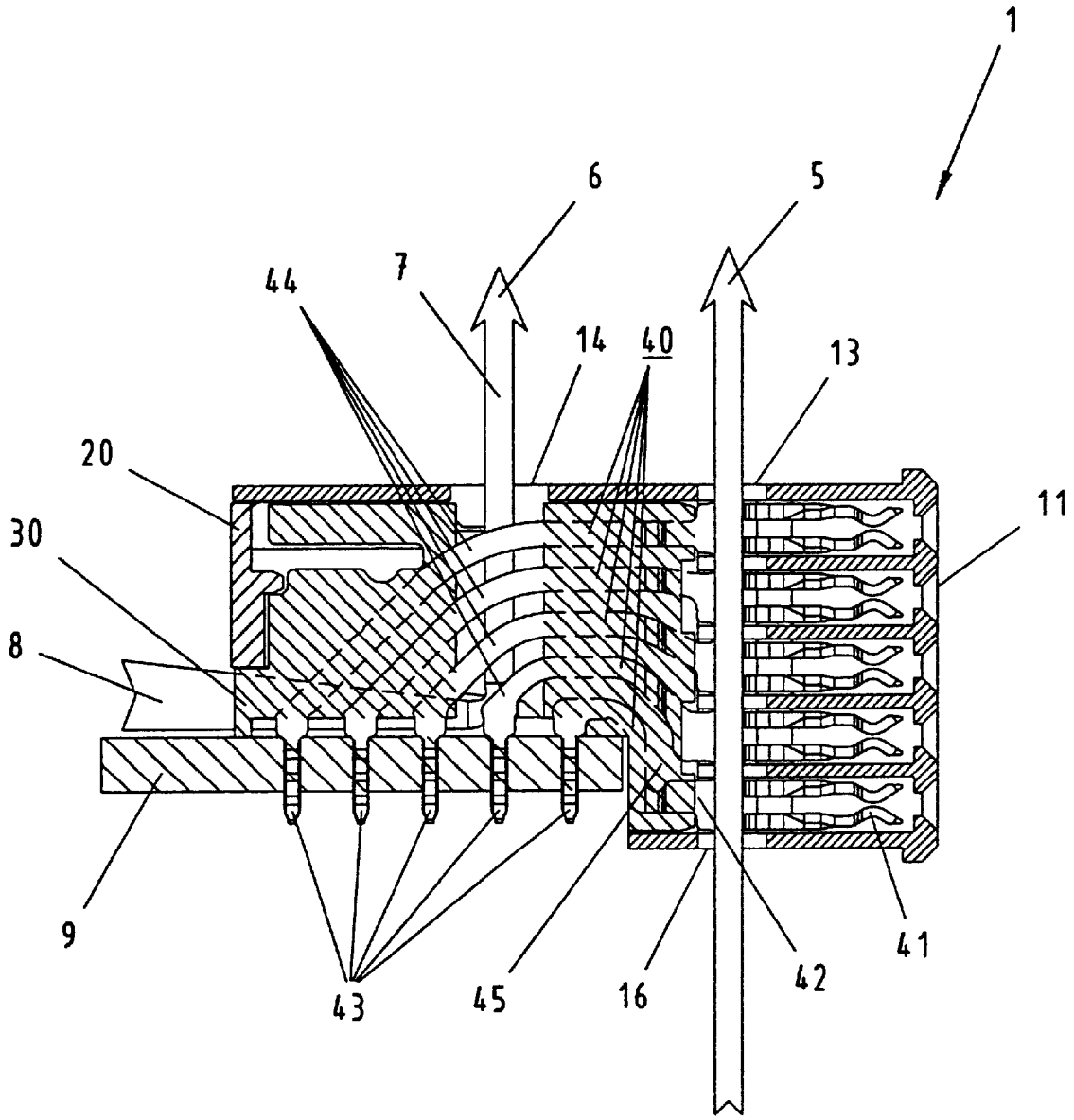
FIG. 1 shows a sectional view of a printed circuit board connector with two channels.

FIG. 1 shows a printed circuit board connector in a cross section, the printed circuit board connector being placed on a printed circuit board 9 and having contact elements 40. Each contact element consists of a contact spring 41, a contact end 43 which is formed as soldering end and engages into bores in the printed circuit board 9, and an intermediate portion 44 connecting the contact spring to the contact end.

The forward portion of the printed circuit board connector 1 which is here formed angled is arranged with his plug-in face 11 in front of the printed circuit board, at least the lowest contact element 45 with its spring contact 41 formed as female contact being arranged below the printed circuit board 9. In this embodiment of the printed circuit board connector, two channels are provided which are independent from each other, namely a first channel 6 and a second channel 5, which are here symbolised by arrows. These arrows indicate the heated air circulating through the channels, which can directly pass over the exposed intermediate portions 44 of the contact elements 40.

The second channel 5 is provided in the forward plug-in portion of the printed circuit board connector perpendicularly to the plug-in direction and perpendicularly to the printed circuit board 9. It is formed as rectangular cavity and is accessible by respective openings 13, 16 in the outer wall above and below the carrier body 10.

The channel 5 is situated such that the root 42 of the contact spring 41 is lying in the flow of the hot gas which results in particularly heating the lowest contact element 45 in addition to the other contact elements.

The first channel 6 is formed by a first partial channel 7, which extends perpendicularly with respect to the printed circuit board 9, and a second partial channel 8, which extends parallel to the printed circuit board. Here again, the two partial channels are symbolised by arrows which indicate the flow of gas through the channels.

Partial channel 8 is limited on the one hand by the printed circuit board and on the other hand by an outer wall 23 of intermediate walls 21 of a segment holder 20 (please refer to FIG. 5*b*), the intermediate walls 21 being formed in a comb-like manner and the outer wall 23 being formed spaced from the printed circuit board 9 and inclined thereto. Partial channel 7 which adjoins perpendicularly to partial channel 8 is formed by a recess 31 in a segment 30 and by the intermediate wall 21 of segment holder 20 adjacent to the segment. The segment accommodates a contact element.

Figure 2:
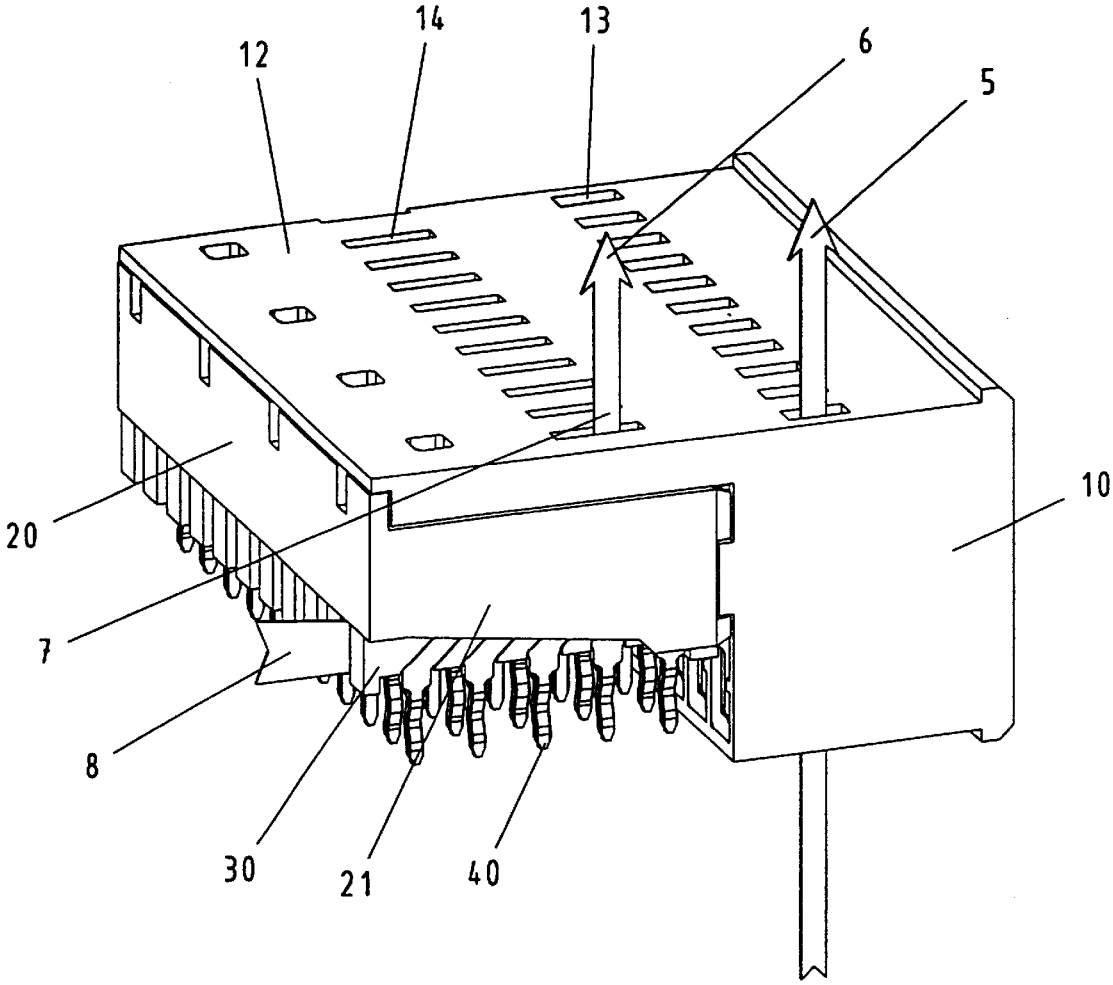
FIG. 2 shows an isometric view of a completely mounted printed circuit board connector.

FIG. 2 shows an isometric view of a completed printed circuit board connector with the second channel 5 and the first channel 6 formed from a combination of partial channels 7, 8.

The printed circuit board connector is formed from the following components: carrier body 10, segment holder 20 and segments 30 inserted into the carrier body, mounting of the printed circuit board connector beginning with insertion of the contact elements 40 into accommodations 32 in the segments 30. Thereafter, the segments 30 are inserted between guiding webs 17 within an accommodation opening in the carrier body 10, and finally the segment holder 20 is inserted into the open intermediate spaces between the segments 30.

Figure 3A:
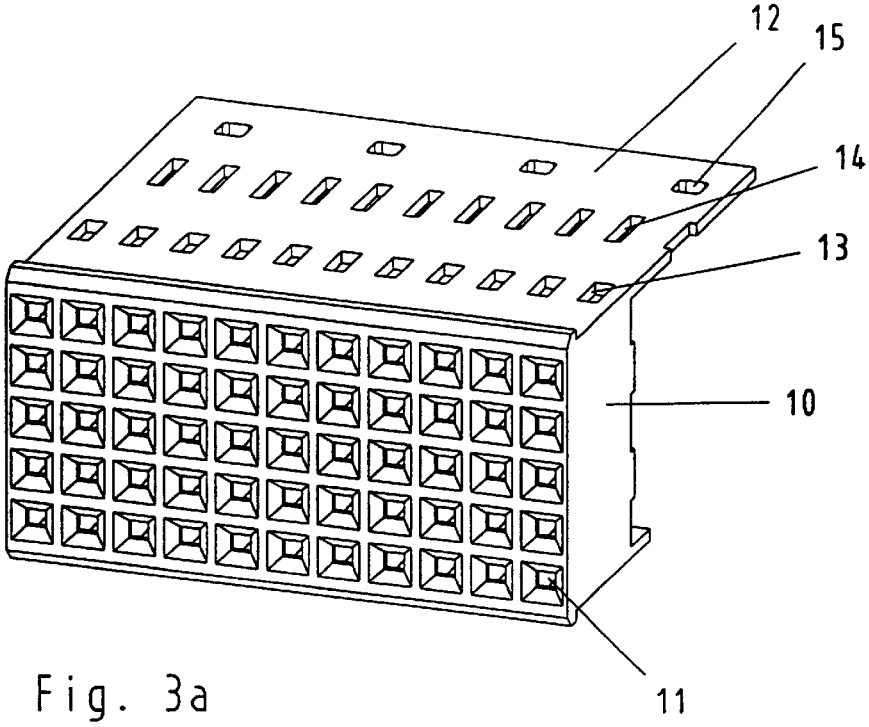
FIG. 3*a* shows an isometric view of a carrier body with a plug-in pattern of the printed circuit board connector.

FIG. 3*a* shows the carrier body 10 of the printed circuit board connector with the plug-in face 11 and the symmetrical arrangement of the insertion funnels for the blade contacts of a complementary connector, which are arranged in columns and rows.

Further, openings 13, 14 serving as exit for channels 5, 6 can be seen in cover 12, and latching openings 15 into which latches 24 of the segment holder 20 engage when the segment holder 20 is positively engaged on the carrier body 10.

Figure 3B:
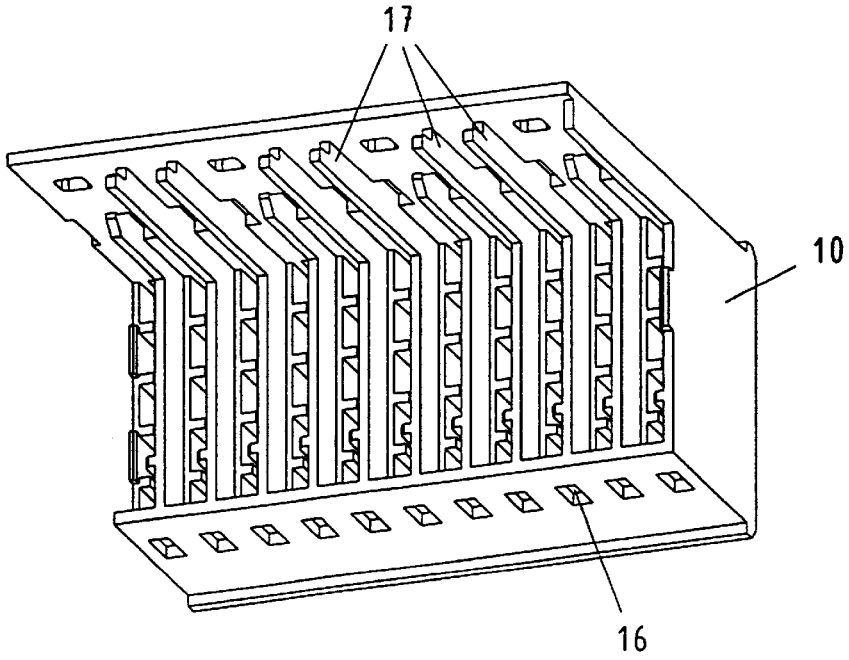
FIG. 3*b* shows an isometric view of the carrier body rotated by 180 degrees.

FIG. 3*b* shows the interior of the carrier body which allows to see the guide webs 17 mentioned with respect to FIG. 2 and forming a separating guide between which the individual segments are inserted. In addition, openings 16 of channels 5 can be seen at the bottom side in the forward plug-in portion.

Figure 4B:
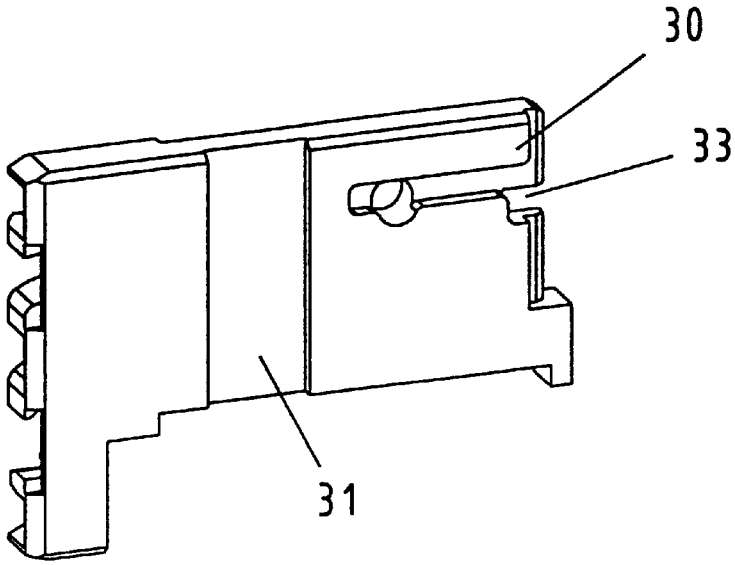
FIG. 4*b* shows an isometric view of a segment with a recess for forming a channel.
Figure 4A:
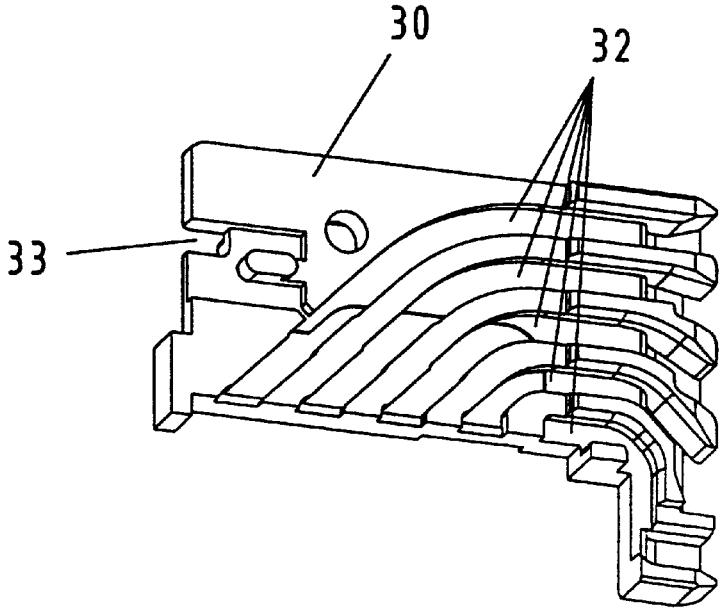
FIG. 4*a* shows an isometric view of a segment.

In FIG. 4*a* is shown in an isometric view a segment 30 of the printed circuit board connector with the accommodations 32 which are formed differently depending from the dimensions of the contact elements 40 to be accommodated. Upon mounting of the printed circuit board connector, a latch 22 of segment holder 20 engages into a groove 33 whereby the segments 30 are held in the carrier body 10.

In FIG. 4*b*, the backward side of the segment 30 shown in FIG. 4*a* is depicted also in an isometric view. Clearly visible is recess 31 which together with adjacent intermediate wall 21 of segment holder 20 forms a partial channel 7 upon completion of the connector.

When the printed circuit board connector is mounted, first the individual segments 30 with contact elements 40 accommodated therein are inserted between the guide webs 17 at the inner side of cover 12 of carrier body 10 which provides hold for the segments 30 at one side. The final hold of the segments in the connector is achieved by means of latches 22 at the rear wall of segment holder 20, which engage in the two grooves 33 of the segments 30.

Figure 5B:
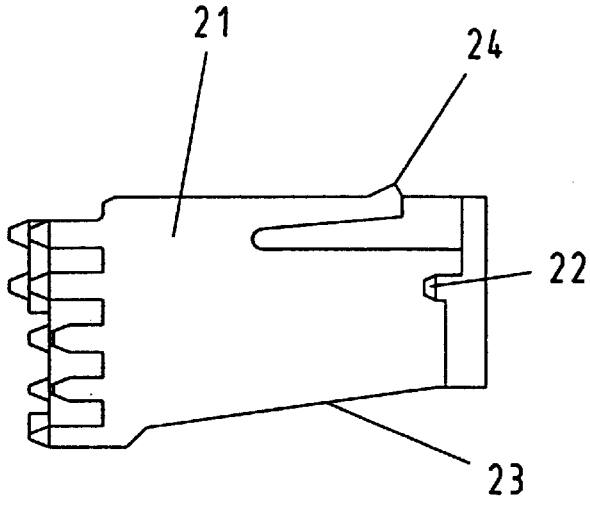
FIG. 5*b* shows a lateral view of an intermediate wall of the segment holder.
Figure 5A:
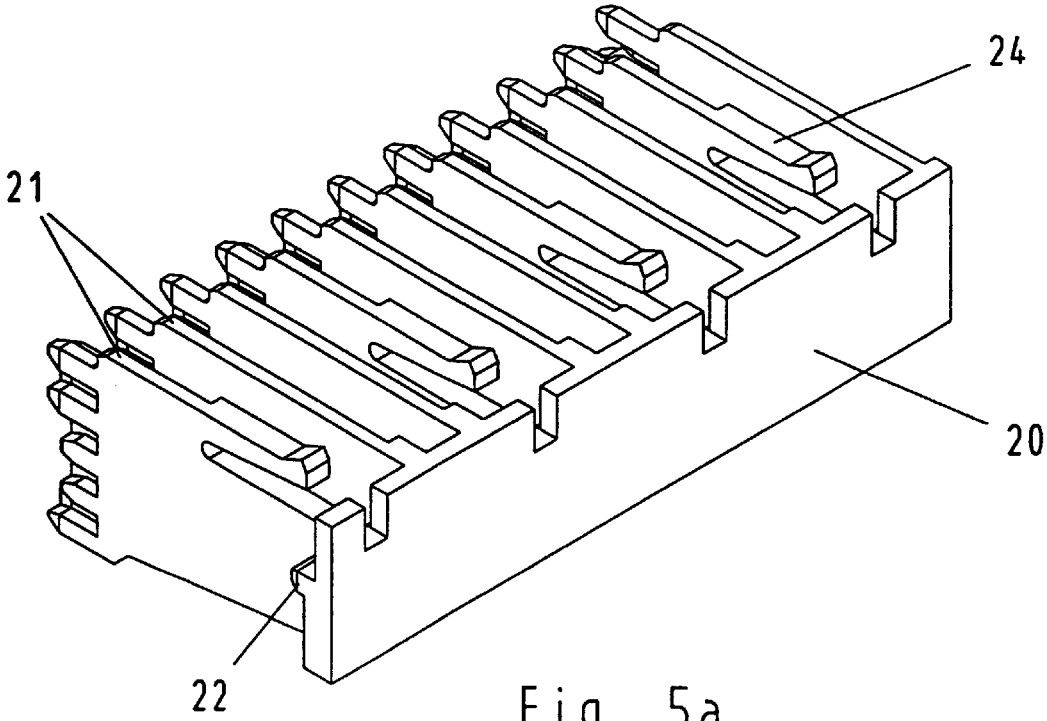
FIG. 5*a* shows an isometric view of a segment holder.

FIG. 5*a* shows segment holder 20 for the individual segments 30 in an isometric view. Segment holder 20 is formed comb-like with a plurality of intermediate walls 21 protruding from a rear wall. Upon completion of the connector, the segments 30 are positively fixed between the intermediate walls 21 which are formed even at both sides.

Elastical latching tongues 24 which are provided at some of the intermediate walls, latch into latching openings 15 in the cover 12 of the carrier body 10 upon mounting and together with the latches 22 of the segment holder, which engage into the grooves 33 of the segments, prevent the connector from disassembling.

FIG. 5*b* shows an intermediate wall 21 of segment holder 20 in a lateral view. Here, the obliquely extending outer wall 23 is visible. The outer wall 23 together with the printed circuit board 9 forms the horizontally extending partial channel 8 after mounting the connector at the printed circuit board.

In an alternative embodiment, channels for the hot gas can also be provided in a connector of this type having straight contact elements.

What is claimed is:

1. A printed circuit board connector having an isolating housing, contact elements arranged in said housing, each of said contact elements comprising a plug-in side, an intermediate portion and a connecting side with contact ends adapted to be mounted at a printed circuit board, and having a plurality of heated air channels leading from one exterior wall of said connector through said intermediate portions of said contact elements to another exterior wall of said connector and allowing heated air to circulate therethrough; wherein each of said channel is formed from a first partial channel extending approximately perpendicularly with respect to said printed circuit board, and a second partial channel extending approximately parallel to said printed circuit board.

2. The printed circuit board connector of claim 1, wherein each of said intermediate portions of said contact elements protrudes into one of said channels.

3. The printed circuit board connector of claim 1, wherein each of said intermediate portions of said contact elements is adjacent to one of said channels.

4. The printed circuit board connector of claim 1, further comprising segments which accommodate said contact elements, said first partial channel being formed by a recess in said segment extending approximately perpendicularly with respect to said printed circuit board.

5. The printed circuit board connector of claim 1, further comprising a segment holder for holding segments accommodating said contact elements, said second partial channel being formed by a distance between a surface of said printed circuit board and an intermediate wall of said segment holder.

6. The printed circuit board connector of claim 5, wherein said distance between said intermediate wall of said segment holder and said surface of said printed circuit board varies along said intermediate wall.

7. The printed circuit board connector of claim 1, wherein a plurality of second channels extending approximately perpendicularly with respect to said printed circuit board is provided in said isolating housing at said plug-in side of said contact elements.

8. The printed circuit board connector of claim 7, wherein said housing has openings through which said second channels extend.

9. The printed circuit board connector of claim 1, wherein said isolating housing is formed from a carrier body, a segment holder and individual segments held in said segment holder and accommodating said contact elements.

10. The printed circuit board connector of claim 1, wherein said contact ends of said contact elements are formed as soldering ends.

11. The printed circuit board connector of claim 1, wherein said contact ends of said contact elements are formed as press-in contact ends.

12. The printed circuit board connector of claim 1, wherein said contact elements are formed angled.

13. A printed circuit board connector having an isolating housing, contact elements arranged in said housing, each of said contact elements comprising a plug-in side, an intermediate portion and a connecting side having contact ends adapted to be mounted at a printed circuit board, a plurality of accommodations being formed in the housing for receiving the contact elements, and a plurality of channels being formed in the housing, the plurality of channels leading from one exterior wall of said connector passing adjacent said intermediate portions of said contact elements without passing through the plurality of accommodations and extending to another exterior wall of said connector such that the plurality of channels allows heated air to circulate therethrough.

* * * * *